US005981888A

United States Patent [19]

Robarge et al.

[11] Patent Number: 5,981,888

[45] Date of Patent: Nov. 9, 1999

[54] CLOSING SPRING LOCK-OUT MECHANISM FOR AN INDUSTRIAL RATED CIRCUIT BREAKER

[75] Inventors: Dean A. Robarge, Southington; James L. Rosen, West Hartford, both of Conn.

[73] Assignee: General Electric Company, Schenectady, N.Y.

[21] Appl. No.: 09/006,793

[22] Filed: Jan. 14, 1998

[51] Int. Cl.[6] ..... H01H 3/00

[52] U.S. Cl. ..... 200/400

[58] Field of Search ..... 200/400, 327

[56] References Cited

U.S. PATENT DOCUMENTS 3,084,238 4/1963 Baskerville .

3,095,489 6/1963 Baird .

3,729,065 4/1973 Baskerville et al. ..... 185/39

4,167,988 9/1979 Acampora et al. ..... 185/40

4,475,021 10/1984 Mochizuki et al. .

*Primary Examiner*—Renee S. Luebke

*Attorney, Agent, or Firm*—Cantor Colburn LLP; Carl B. Horton

[57] ABSTRACT

A circuit breaker contact spring blocking arrangement is by-passed by means of a lock-out system that interacts between the circuit breaker contact spring closing shaft and the circuit breaker closing lock-out system when the circuit breaker contacts are in the OPEN condition.

14 Claims, 6 Drawing Sheets

CLOSING SPRING LOCK-OUT MECHANISM FOR AN INDUSTRIAL RATED CIRCUIT BREAKER

BACKGROUND OF THE INVENTION

Air circuit breakers as described within U.S. Pat. No. 3,095,489 entitled "Manual Charging Means for Stored Energy Closing Mechanisms of Electric Circuit Breakers" and U.S. Pat. No. 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

Such air circuit breakers are usually provided with a motor operator such as described in U.S. Pat. No. 4,167,988 entitled "Ratcheting Mechanism for Circuit Breaker Motor Operator" or a manual handle as described in U.S. Pat. No. 3,729,065 entitled "Means for Charging A Stored Energy Circuit Breaker Closing Device" for charging the powerful closing springs contained within the air circuit breaker operating mechanism.

When the circuit breaker closing springs are brought to their fully-charged conditions, it is important that the springs do not become inadvertently discharged while an operator has hold of the charging handle in order to avoid damage to the ratchet mechanism and the associated air circuit breaker contacts. An early arrangement of a latching means to prevent rotation of a closing springs charging handle is found in U.S. Pat. No. 4,475,021 entitled "Air Circuit Breaker".

When the circuit breaker closing springs are completely charged, the holding pawl is removed from the charging gear to allow the charging shaft to rotate in the reverse direction when the circuit breaker closing button is activated, as described in U.S. Pat. No. 5,883,351 entitled "Ratcheting Mechanism for Industrial-Rated Circuit Breaker" filed on May 27, 1997.

One arrangement for releasing charged circuit breaker closing springs to close the circuit breaker contacts is found in U.S. patent application Ser. No. 08/864,165 entitled "Closing Springs Release Mechanism for industrial-Rated Circuit Breaker" filed on May 28, 1997.

Two separate arrangements for interlocking the circuit breaker closing button to prevent release of the circuit breaker closing springs to forestall closing the circuit breaker contacts are described within U.S. Pat. No. 5,889,250 entitled "Circuit Breaker Closing Springs Button Interlock Mechanism" filed on Jun. 19, 1997 and U.S. patent application Ser. No. 08/878,594 entitled "Push-button Interlock Mechanism for an Industrial-Rated Circuit Breaker" filed on Jun. 19, 1997.

In some situations, when remote circuit breaker accessory devices are employed, it is necessary to release the circuit breaker interlock to allow the circuit breaker closing spring to close the circuit breaker contacts. However, it is also required to allow the closing spring to become charged so that the contacts can be immediately re-closed following an overcurrent occurrence. To allow a remotely-operated accessory to release the circuit breaker closing spring when the contacts have already closed could result in damage both to the circuit breaker contacts as well as to the components within the circuit breaker closing spring assembly, per se.

One purpose of the invention is to provide a lock-out arrangement whereby the circuit breaker closing spring can be released to close the circuit breaker contacts from the OPEN to CLOSED condition when the circuit breaker contacts are separated and whereby the circuit breaker closing spring is prevented from becoming released after the circuit breaker contacts have closed.

SUMMARY OF THE INVENTION

A circuit breaker contact spring blocking arrangement is lock-out by means of a lock-out system that interacts between the circuit breaker contact spring closing shaft and the circuit breaker closing lock-out system when the circuit breaker contacts are in the OPEN condition. An operating lever within the lock-out system interfaces with a blocking link and a closing link at one end and with the circuit breaker closing shaft link at an opposite end thereof to deter rotation of the circuit breaker closing shaft until and unless the contacts are in the OPEN condition.

DESCRIPTION OF THE PREFERRED EMBODIMENT

Figure 1:
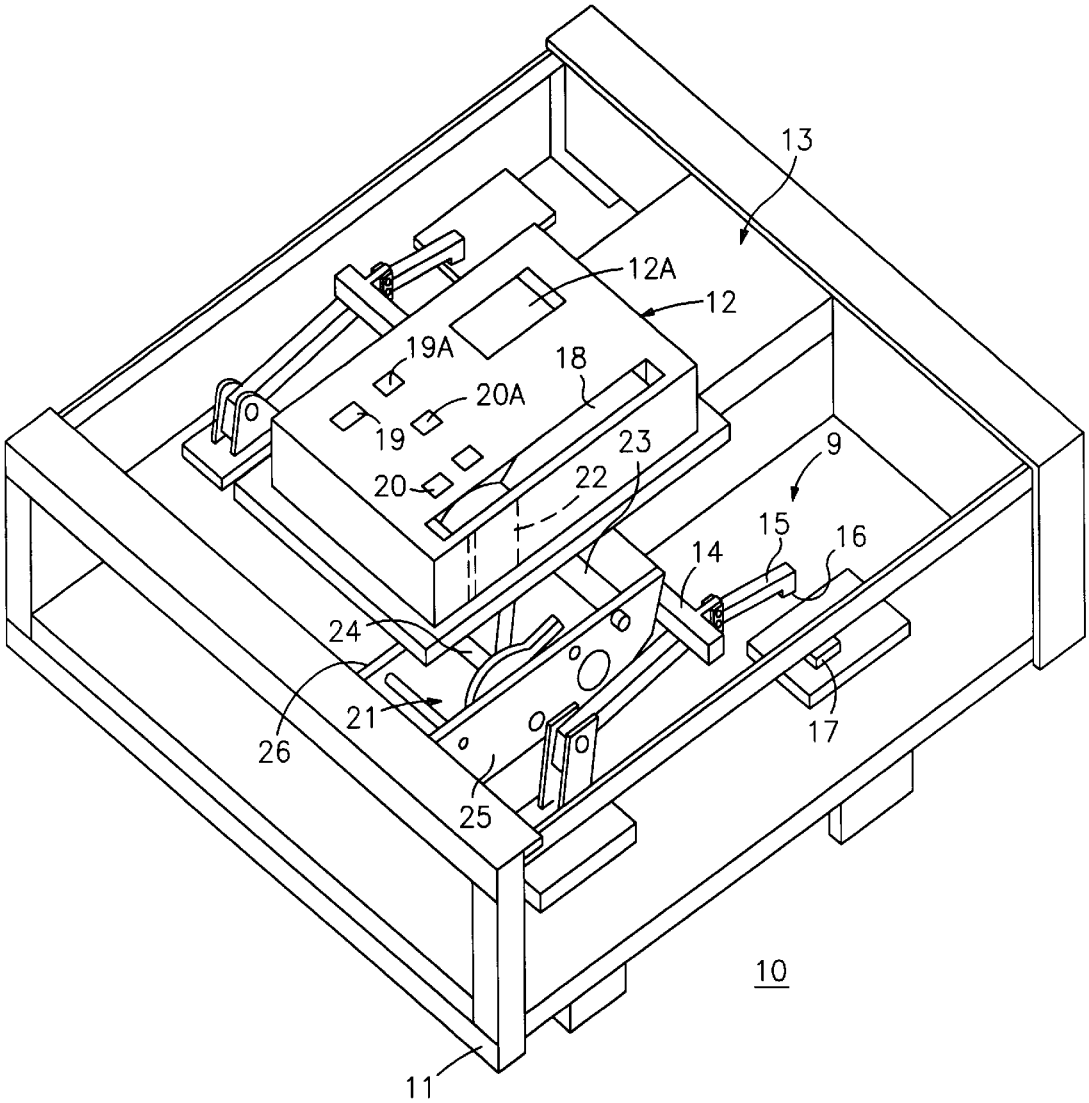
FIG. 1 is top perspective view of an air circuit breaker containing the contact spring blocking lock-out system according to the invention.

The air circuit breaker 10 of FIG. 1 is similar to that described within the aforementioned U.S. Pat. No. 3,095,489 and includes a metal frame 11 which supports circuit breaker cover 12, the trip unit programmer 12A and the operating mechanism enclosure 13. The trip unit programmer 12A is similar to that described in U.S. Pat. No. 4,672,501 entitled "Circuit Breaker and Protective Relay Unit". The cover 12 further includes a TRIP or OFF button 19 for releasing the circuit breaker operating mechanism 21 contained within the enclosure 13 for separating the circuit breaker contacts 16, 17 within the contact assembly 9 to their open condition and a closing button 20 for moving the contacts 16 to their closed position. The viewing windows 19A, 20A provide viewing access to ON/OFF condition of the circuit breaker contacts 16, 17. The circuit breaker movable contact arms 15 within each pole of a three pole circuit arrangement are interconnected by means of the operating mechanism crossbar 14 to insure that movable and fixed contacts 16, 17 within the separate poles both open and close in unison. The circuit breaker operating mechanism closing spring assembly 21 operates in the manner described in the aforementioned U.S. Pat. No. 3,729,065 by allowing the operating mechanism closing spring described therein to be charged by means of the charging shaft 23 and released by means of the closing shaft 24 that connects between the operating mechanism sideframes 25, 26. The manual operating handle 18 interacts with the operating mechanism 21 by means of a pair of plate connectors, one of which is indicated at 22 to move the contacts 16 between the OPEN and CLOSED conditions along with the TRIP or OFF button 19 and the closing button 20, as described earlier.

Figure 2:
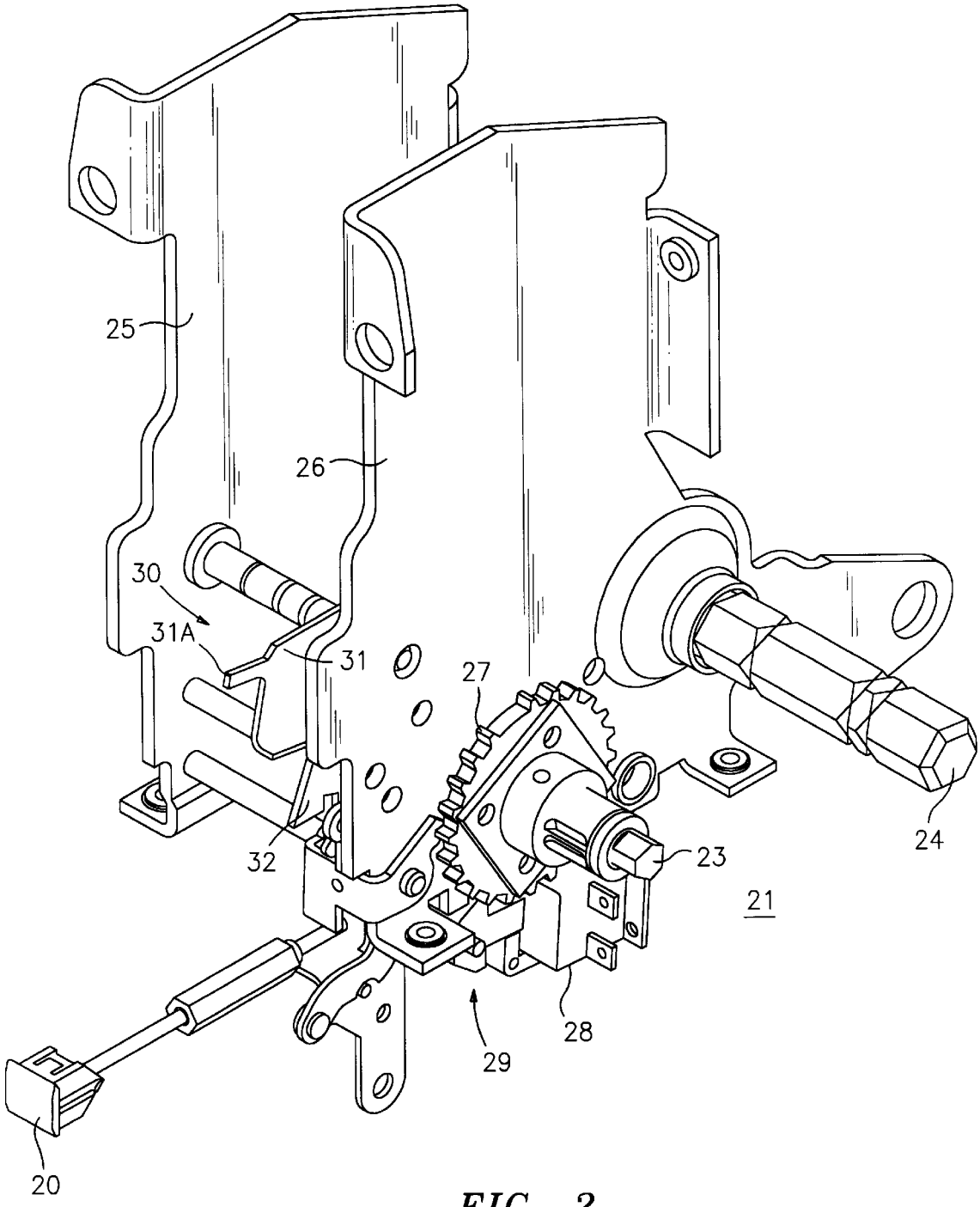
FIG. 2 is a top perspective view of the contact closing spring assembly apart from the operating components contained within the circuit breaker of FIG. 1.

The operating mechanism closing spring assembly 21 is depicted in FIG. 2 apart from the circuit breaker 10 of FIG. 1 to detail the positioning of the charging shaft 23 and the closing shaft 24 intermediate the operating mechanism sideframes 25, 26 and the position of the closing spring lockout system 29 and closing solenoid 28 relative to the charging gear 27 arranged on the charging shaft 23 and the closing button 20 arranged on the top of the circuit breaker cover 12 of FIG. 1. The closing spring lockout system 29 as described in the aforementioned U.S. Pat. No. 5,889,250 and application Ser. No. 08/878,594 prevents operation of the closing solenoid 28 or the closing button 20 until and unless certain events have occurred.

Figure 3:
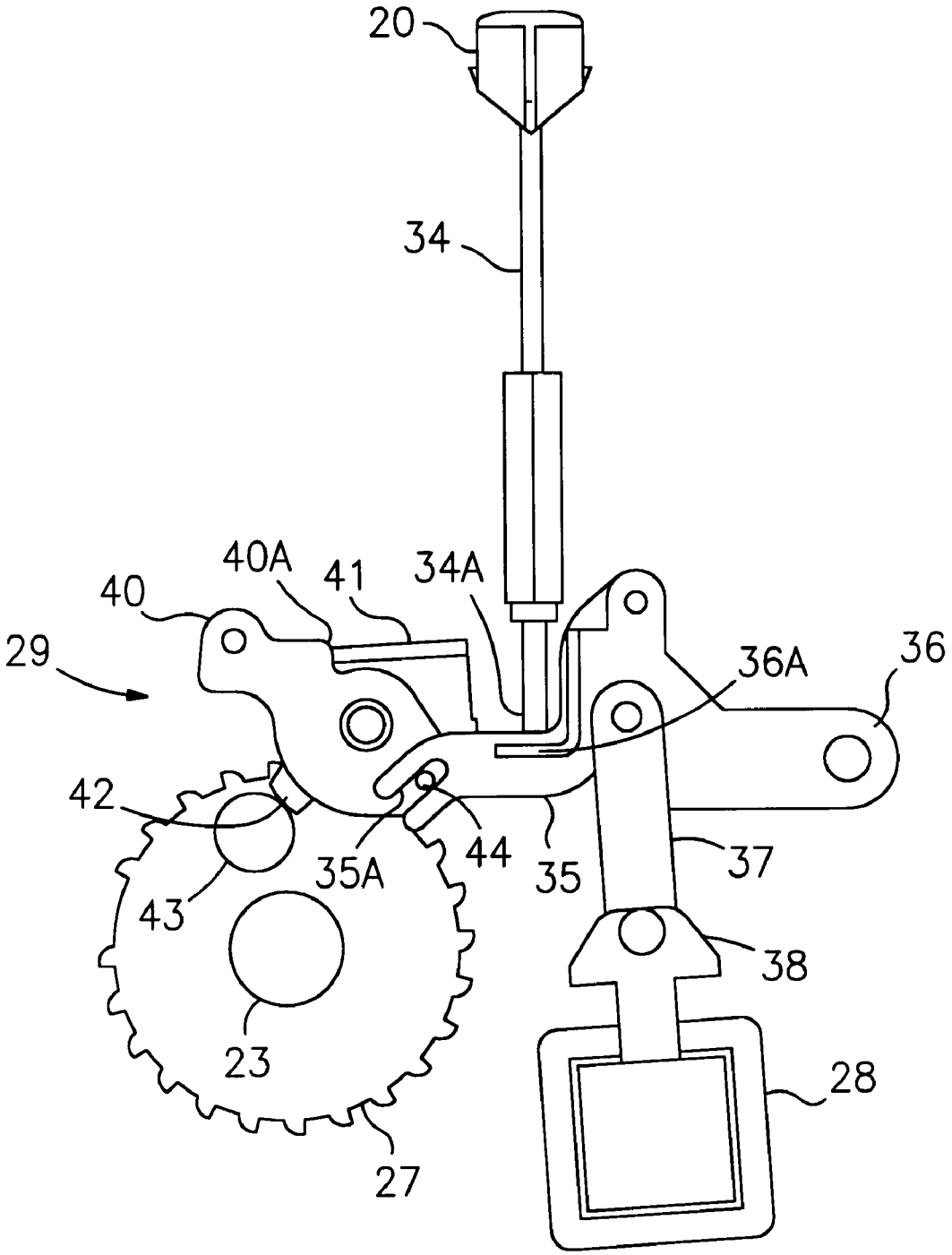
FIG. 3 (PRIOR ART)
FIG. 3 is side plan view of the Prior Art contact closing solenoid assembly contained within the closing spring assembly of FIG. 2.

Before describing the lock-out system of the invention, it is helpful to review the Prior Art closing spring system 29 shown in FIG. 3 and described in U.S. Pat. No. 5,905,240 entitled "Contact Closing Solenoid Assembly for Air Circuit Breakers" filed on Oct. 6, 1997. Either the closing button 20 or the closing solenoid 28 may release the circuit breaker closing spring (not shown) as follows. When the closing button 20 is depressed by an operator the end 34A of the push button shaft 34 contacts the lower drive link tab 36A. This causes the upper drive link 35 to move towards the charging shaft 23 whereby slot 35A drives closing driver pin 44 in the same direction. As the closing prop driver pin 44 moves towards the charging shaft 23, the closing prop driver 40 is rotated in a clockwise manner as viewed in FIG. 3, whereby a detent 40A makes contact with the closing prop 41 causing the closing prop 41 to also rotate in a clockwise manner whereby the closing prop post 42 rotates away from the charging gear pin 43 allowing the charging shaft 23 to spin in a clockwise manner thus closing the circuit breaker. In a likewise manner, the closing solenoid 28, once activated, retracts the solenoid plunger 38 which is attached to the connecting link 37 which causes the lower drive link 36 to rotate again causing the upper drive link 35 to move towards the charging shaft 23 whereby closing prop driver pin 44 is caused to move in the same direction by slot 35A. After the closing prop driver 40 and closing prop 41 have moved in the same manner as described above, then the charging shaft is once again allowed to rotate in a clockwise manner causing the circuit breaker to close.

Figure 4:
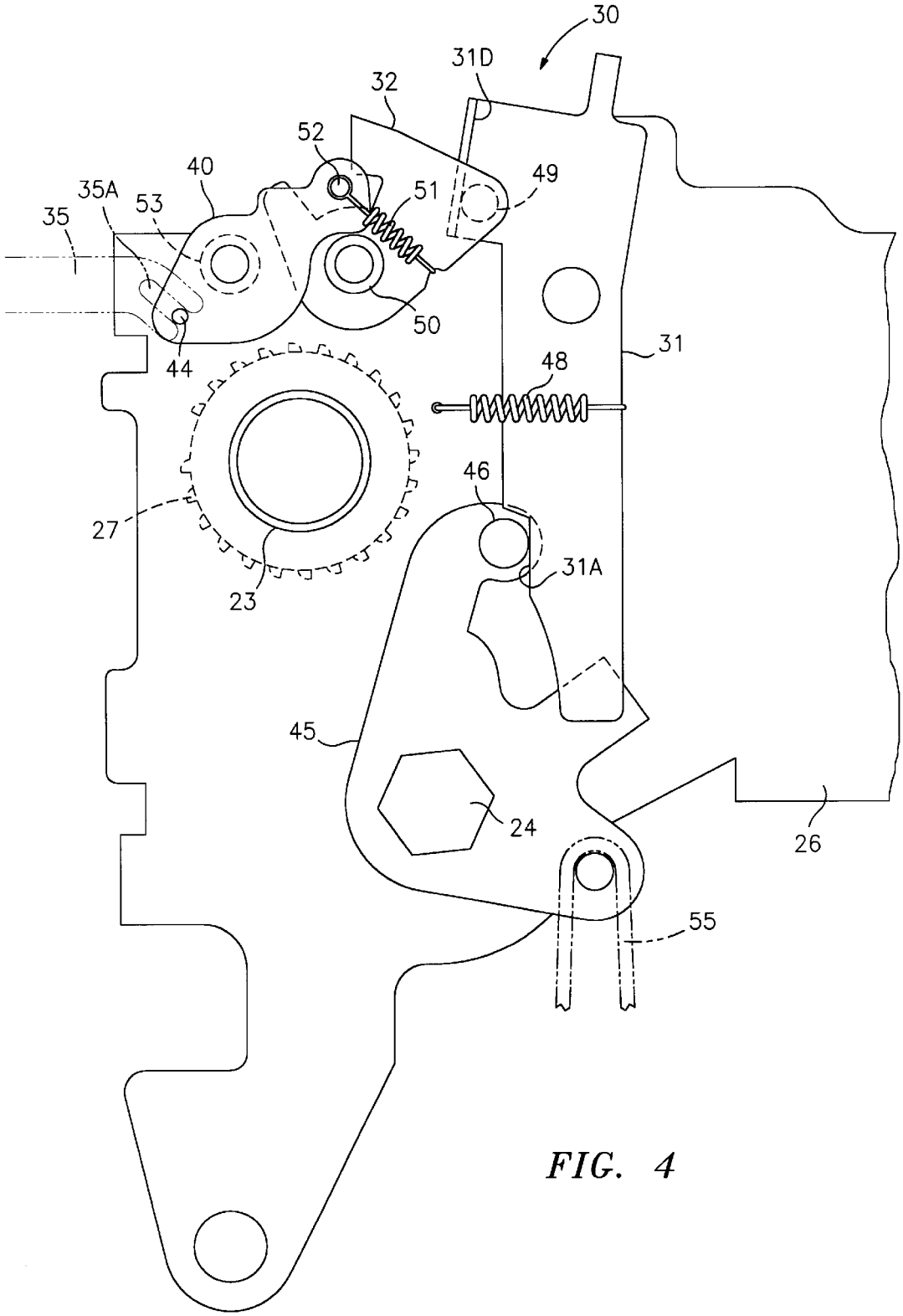
FIG. 4 is side plan view of the contact spring blocking lock-out system contained within the contact closing spring assembly of FIG. 2 in an unlatched condition with the circuit breaker contacts in the OPEN condition.

By the addition of a blocking link 32 as shown in FIG. 4 on a separate pivot 50 on the circuit breaker closing spring operating mechanism sidewall 26 within the lock-out system 30 and attaching the blocking link 32 to the closing prop driver 40 on a separate pivot 53, by means of the extension spring 51, the blocking link 32 interacts with the closing prop driver 40 to control the release of the charging gear 27 on the charging shaft 23.

The blocking link 32 further interacts with operating lever 31 in the lock-out system 30 by means of the blocking pin 49 on tile blocking link 32 and the release tab 31D on the operating lever in the manner to be described below to release the charging shaft 23. The closing shaft 24 connects with the circuit breaker movable contact arm 15 (FIG. 1) to open and close the circuit breaker contacts 16, 17 of FIG. 1 by means of a clevis 55, shown in phantom and the closing shaft link 45 as described in the recently aforementioned U.S. Pat. No. 5,905,240. In the arrangement depicted in FIG. 4, the extension spring 48 which is anchored to the mechanism side wall 26 and the operating lever 31, rotates the operating lever 31 to interface with the drive pin 46 at the camming surface 31A. The operating lever 31 has the release tab 31D that lifts and rotates the blocking link 32 via the blocking pin 49 thereby allowing the prop driver 40 to rotate in a counter-clockwise direction when acted upon by the upper drive link 35, whereby the closing shaft 24 is free to rotate and close the circuit breaker contacts 16, 17 of FIG. 1 by means of the clevis 55, as described earlier.

Figure 5:
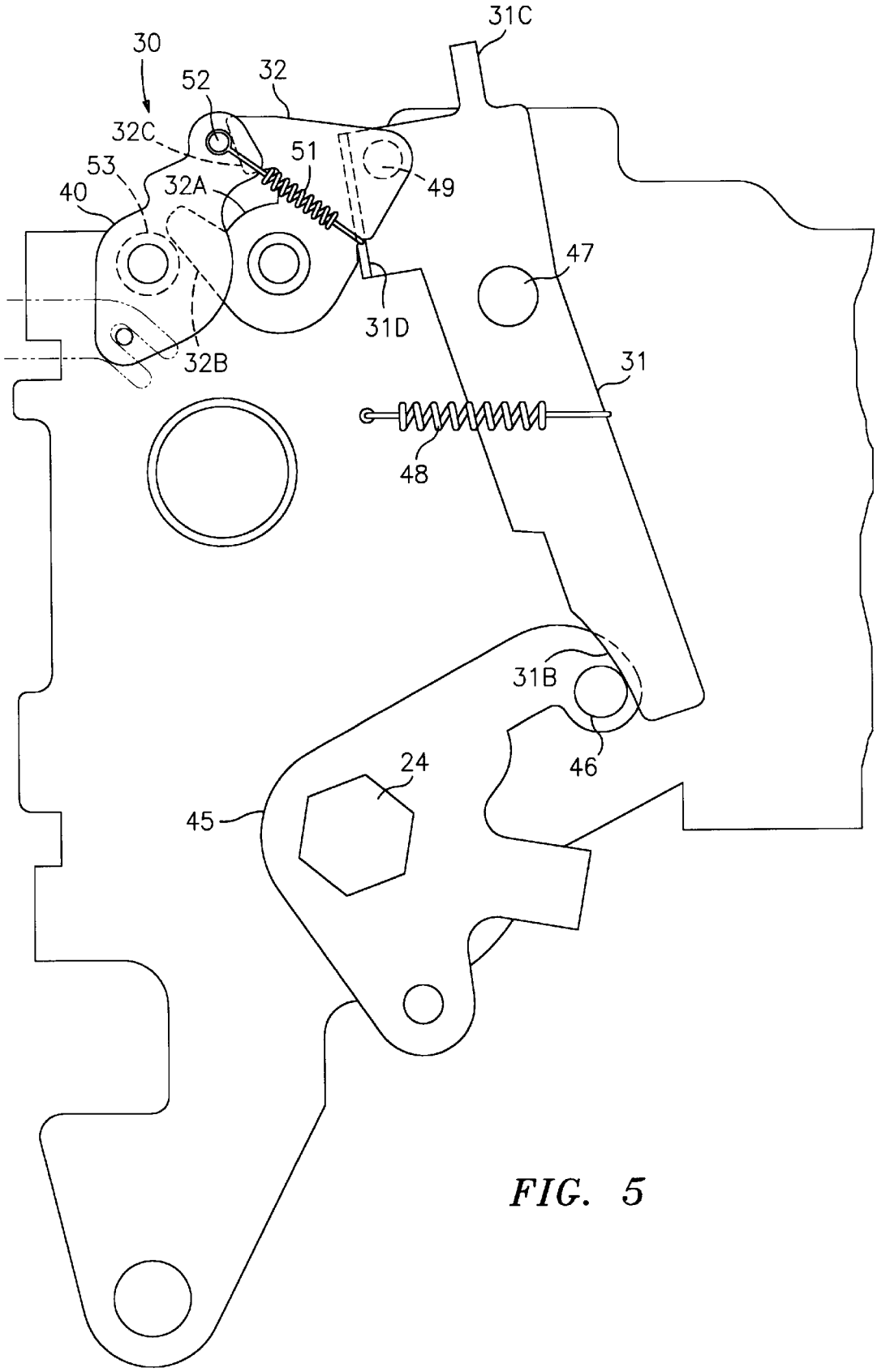
FIG. 5 is side plan view of the contact spring blocking lock-out system contained within the contact closing spring assembly of FIG. 2 in an unlatched condition with the circuit breaker contacts in the CLOSED condition.

As the circuit breaker contacts move to the CLOSED condition, the lock-out system 30 assumes the condition depicted in FIG. 5 with the accessory tab 31C on the operating lever 31 as shown, and wherein the drive pin 46 on the closing shaft link 45 attached to the closing shaft 24 remains against the second camming surface 31B on the operating lever 31 about the pivot 47 upon the urgence of the extension spring 48. The blocking pin 49 on the blocking link 32 is away from the release tab 31D and the closing link pin 52 on the closing prop drive 40 is at the edge of the blocking link slot 32A under the urgence of the extension spring 51. The blocking link 32 has rotated counter-clockwise against the stop surface 32B on the prop drive shaft 53. The prop driver 40, under the urgence of the extension spring 51, lifts the blocking link 32 by interaction of closing link pin 52 and the lift surface 32C once the close push-button 20 is released.

Figure 6:
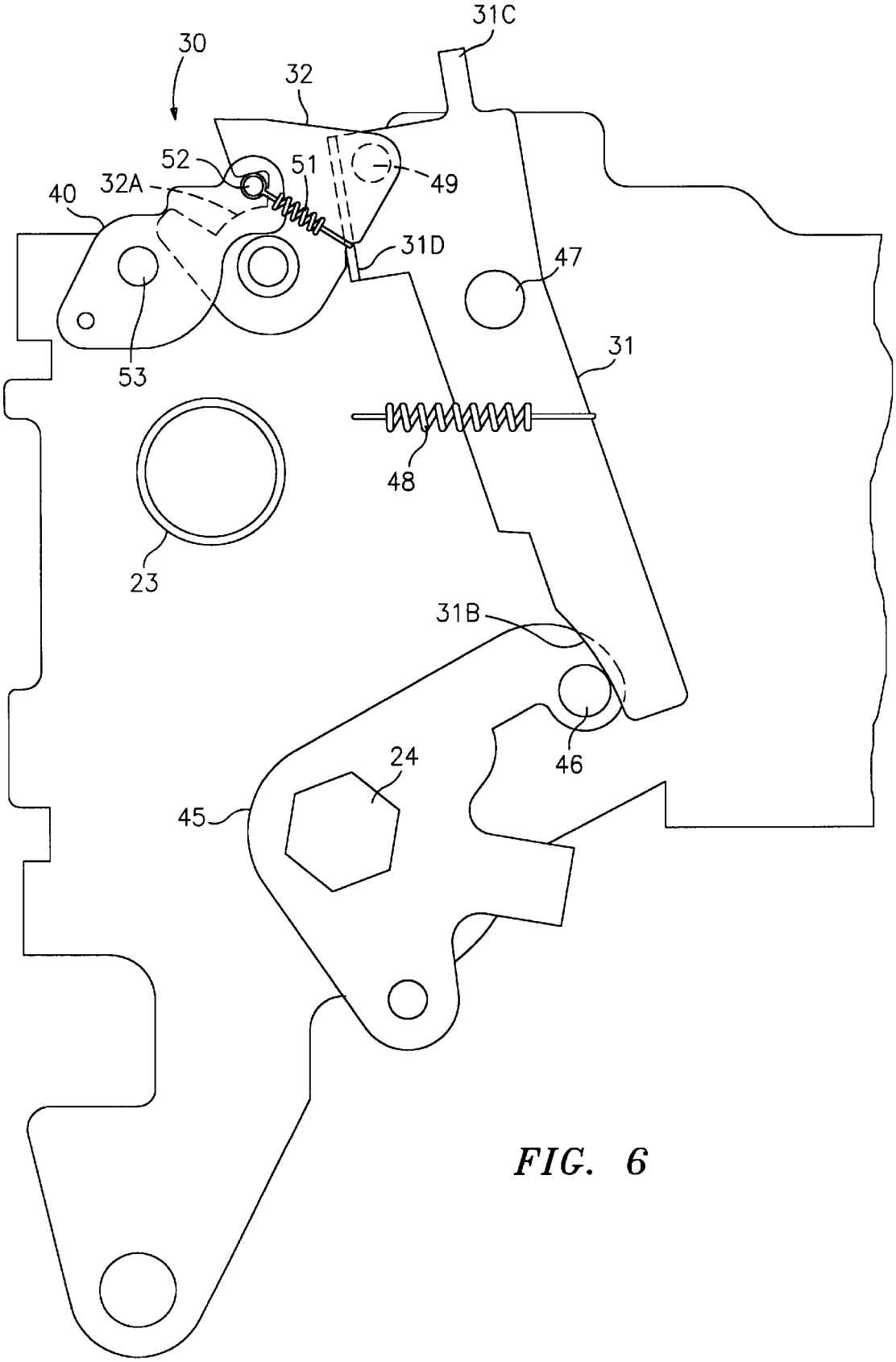
FIG. 6 is side plan view of the contact spring blocking lock-out system contained within the contact closing spring assembly of FIG. 2 in a latched condition with the circuit breaker contacts in the ON condition.

Once the circuit breaker contacts have moved to the CLOSED condition, the lock-out system 30 assumes the condition depicted in FIG. 6 with the accessory tab 31C as shown, wherein the drive pin 46 on the closing shaft link 45 attached to the closing shaft 24 remains against the second camming surface 31B on the operating lever 31 about the pivot 47 upon further urgence of the extension spring 48. The blocking pin 49 on the blocking link 32 is away from the release tab 31D and the closing link pin 52 on the closing prop drive 40 is drawn within the blocking link slot 32A in the blocking link 32 under the continued urgence of the extension spring 51. The closing prop drive 40 is now prevented from further rotation about the closing prop pivot 53 to thereby prevent rotation of the charging shaft 23 or the closing shaft 24 in the manner described in the aforementioned U.S. Pat. application Ser. No. 08/878,594. In the event the circuit breaker contacts 16, 17 within the circuit breaker 10 of FIG. 1 again become separated, either manually by operation of the closing button 20 or upon operation of the trip unit 12A upon occurrence of an overcurrent condition within an associated protected circuit, the lock-out release system 30 of FIG. 6 returns to the condition depicted earlier in FIG. 4.

What is claimed is:

1. A circuit breaker closing spring lock-out release assembly for use with a circuit breaker closing system comprising:

a blocking link arranged for pivotally attaching to a circuit breaker closing spring operating mechanism adjacent to a closing prop driver;

said blocking link defining a blocking link slot on one side and a blocking pin on another side thereon;

an operating lever for pivotally attaching to said circuit breaker closing spring operating mechanism;

said operating lever defining a release tab on one end and a camming surface on a second end opposite said one end thereof;

a closing shaft link arranged for mounting on a closing shaft and rotating with said closing shaft;

said closing shaft link having a drive pin for interacting with said first and second surface on said operating lever;

whereby said operating lever release tab abuts said blocking pin to allow rotation of a circuit breaker closing spring charging shaft to allow release of a circuit breaker closing spring to close a pair of circuit breaker contacts when said circuit breaker contacts are in an OPEN condition.

2. The circuit breaker closing spring lock-out release assembly of claim 1 wherein said closing prop driver is rotated about a closing prop driver pivot and said blocking link is rotated about a blocking link pivot, said blocking link and said closing prop driver being attached together by a first extension spring.

3. The circuit breaker closing spring lock-out release assembly of claim 2 wherein said closing prop drive further includes a closing prop drive pin, said closing prop drive pin being outside said blocking link slot when said circuit breaker contacts are in said OPEN condition and said closing prop drive pin is within said blocking link slot when said circuit breaker contacts are in a CLOSED condition.

4. The circuit breaker closing spring lock-out release assembly of claim 1 wherein said operating lever is arranged on an operating lever pivot and a first and second camming surface are arranged on said second end remote from said blocking pin.

5. The circuit breaker closing spring lock-out release assembly of claim 4 wherein said operating lever is positioned on said circuit breaker closing spring operating mechanism by an operating lever extension spring.

6. The circuit breaker closing spring lock-out release assembly of claim 4 wherein said operating lever first camming surface engages a closing shaft link drive pin arranged on a first end of a circuit breaker closing spring closing shaft link when said circuit breaker contacts are in an OPEN condition and said operating lever second camming surface engages said closing shaft link drive pin when said circuit breaker contacts are in a CLOSED condition.

7. The circuit breaker closing spring lock-out release assembly of claim 6 wherein said circuit breaker closing spring closing shaft link engages a circuit breaker moveable contact arm clevis at a second end of said closing shaft link opposite said first end.

8. A circuit breaker comprising:

a support frame;

an operating mechanism within said support frame, said operating mechanism including a contact closing spring, a circuit breaker charging shaft and a contact spring closing shaft;

a movable contact arm interacting with said contact closing spring for opening and closing a pair of circuit breaker contacts; and a blocking link arranged for pivotally attaching to said operating mechanism intermediate a closing prop driver and an operating lever, said blocking link defining a blocking link slot on one side and a blocking pin on another side thereon, said operating lever defining a release tab on one end and a camming surface on a second end opposite said one end thereof;

whereby said operating lever release tab abuts said blocking pin to allow rotation of said circuit breaker charging shaft to allow release of a circuit breaker closing spring to close said pair of circuit breaker contacts when said circuit breaker contacts are in an OPEN condition.

9. The circuit breaker of claim 8 wherein said operating lever is arranged on an operating lever pivot remote from said blocking pin.

10. The circuit breaker of claim 8 wherein said closing prop drive is rotated by means of a closing prop drive pivot and said blocking link is rotated by means of a blocking link pivot, said blocking link and said closing prop drive being attached together by means of a first extension spring.

11. The circuit breaker of claim 10 wherein said closing prop drive further includes a closing prop drive pin, said closing prop drive pin being outside said blocking link slot when said circuit breaker contacts are in said OPEN condition and said closing prop drive pin is within said blocking link slot when said circuit breaker contacts are in a CLOSED condition.

12. The circuit breaker of claim 8 when said circuit breaker contacts are in an OPEN condition, said operating lever is positioned on said circuit breaker closing spring operating mechanism by an operating lever extension spring; and said operating lever camming surface having a first and second camming surface on said second end.

13. The circuit breaker of claim 12 wherein said operating lever first camming surface engages a closing shaft link drive pin arranged on a first end of a circuit breaker closing spring closing shaft link when said circuit breaker contacts are in an OPEN condition and said operating lever second camming surface engages said closing shaft link drive pin when said circuit breaker contacts are in a CLOSED condition.

14. The circuit breaker of claim 13 wherein said circuit breaker closing spring closing shaft link engages a circuit breaker moveable contact arm clevis at a second end of said closing shaft link opposite said first end.

* * * * *